US006876750B2

(12) United States Patent
Allred et al.

(10) Patent No.: US 6,876,750 B2
(45) **Date of Patent: *Apr. 5, 2005**

(54) METHOD AND APPARATUS FOR TUNING DIGITAL HEARING AIDS

(75) Inventors: Rustin W. Allred, Plano, TX (US); Mhamed Ibnabdeljalil, San Francisco, CA (US); Keith G. Gutierrez, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 225 days.

This patent is subject to a terminal disclaimer.

(21) Appl. No.: 09/967,062

(22) Filed: Sep. 28, 2001

(65) Prior Publication Data

US 2003/0063763 A1 Apr. 3, 2003

(51) Int. Cl.[7] ..... H04R 25/00
(52) U.S. Cl. ..... 381/314; 381/60; 600/559
(58) Field of Search ..... 381/314, 312, 381/60, 107, 103; 600/559; 708/322, 323

(56) References Cited

U.S. PATENT DOCUMENTS 4,548,082 A * 10/1985 Engebretson et al. ..... 73/585
4,577,641 A * 3/1986 Hochmair et al. ..... 381/312
4,615,007 A * 9/1986 King et al. ..... 600/559
6,292,571 B1 * 9/2001 Sjursen ..... 381/312
6,721,428 B1 * 4/2004 Allred et al. ..... 381/103

FOREIGN PATENT DOCUMENTS

WO WO 90/09760 * 9/1990 ..... 381/312

* cited by examiner

*Primary Examiner*—Duc Nguyen
*Assistant Examiner*—Lun-See Lao
(74) *Attorney, Agent, or Firm*—Robert D. Marshall, Jr.; W. James Brady, III; Frederick J. Telecky, Jr.

(57) ABSTRACT

A method for generating digital filters for tuning a hearing aid to enhance hearing ability. Data is provided, for a range for a target response curve representative of enhanced hearing ability of sound level versus frequency. Second digital data is also generated, for an initial response curve or audiogram of an individual's hearing ability. The first digital data is compared with the second digital data and it is determined whether the initial response curve is within the tolerance range. If not, digital audio filters are iteratively generated, and the digital audio filters are applied to digital data representing received sound signals to generate third digital data to enhance hearing. Parameters of the digital audio filters are automatically optimized until the compensated response curve is within the tolerance range or a predetermined number of digital audio filters has been reached.

2 Claims, 7 Drawing Sheets

METHOD AND APPARATUS FOR TUNING DIGITAL HEARING AIDS

CROSS-REFERENCE TO RELATED

This invention is related to Ser. No. 09/191,944 filed Nov. 13, 1998, and having common inventors with the present application. application Ser. No. 09/191,944 is incorporated in its entirety into this application.

TECHNICAL FIELD OF THE INVENTION

This invention relates to digital hearing aids, and more particularly relates to tuning such digital hearing aids to compensate for an individual hearing loss.

BACKGROUND OF THE INVENTION

Over the last two decades, almost every type of audio equipment turned to digital circuitry to improve and/or enhance performance. Available equipment to assist the hearing impaired (both severe and modest) includes both analog and digital, although digital approaches are gaining more and more ground because of size and circuit flexibility.

For typical loudspeakers, to render high quality audio, inherent variations with frequency in the amplitude, or sound level, of the sound reproduced by the speaker for a given level of signal driving the loudspeaker must be normalized. This process is known as speaker equalization. Traditionally, the design of equalizers has been performed by an experienced technician who uses precision instruments to measure the speaker characteristics and adjusts filters as needed to equalize the speaker. However, as will be appreciated, the speaker may be equalized without taking the environment into account if the speaker will be moved to several different environments, or there is no way to know what the environment might be or the "environment" changes. Alternatively, the speaker can be equalized to account not only for deficiencies of the speaker itself, but also the effects of the environment. In this way, the spectral performance of the loudspeaker is compensated so that for a given audio signal power level the amplitude of the resulting sound is approximately the same for all audio frequencies in the performance range of the loudspeaker. Such a procedure is manual, time-consuming and requires significant expertise but still does not necessarily yield the best equalization possible for the resources expended. In addition, the speaker equalization equipment often requires many cubic feet of space.

Hearing aids, although including an amplifier and a speaker, also include features which are at odds with the typical concert or public address loudspeaker. For example, whereas an amplifier and speaker system used for concerts and the performing arts demands extreme amplification and huge speakers, the smaller the size of the hearing aid the better. Also as was discussed above, where speaker equalization or a flat frequency response of the speaker or sound system is demanded for concerts and public performance, a properly tuned hearing aid does just the opposite. That is, the properly tuned hearing aid carefully avoids amplification of those frequencies at which an individual has acceptable or normal hearing while at the same time providing substantial amplification to frequencies at which the individual is impaired. It is, of course, possible that an individual's hearing loss could be the same across the audio spectrum in which case a hearing aid with a flat response might be desirable. Typically, however, hearing loss is frequency dependent, and for most individuals, the loss is progressively worse at frequencies at the high end of the audio spectrum. Although these differences result in opposite demands for a public sound system and an individual's hearing aid, much of the technical theory required to satisfy these opposite demands is the same. For example, whereas sound system equalization schemes may be used to compensate for sound power or volume output variations at different frequencies to obtain a flat sound system response, the same scheme may be used for sound system "unequalization." That is, the scheme intentionally varies the power output of the hearing aid at various frequencies to achieve an output which is intentionally not equalized. This compensates for the wearer's impairment so that in most applications, the wearer perceives or hears as flat a response as is possible over the audio spectrum. However, as will be discussed hereinafter, a "hearing aid" may also be used by an individual with normal hearing for purposes of "enhancing" the individual's hearing ability above normal with respect to specific sounds, frequencies or environments. For these uses, the "hearing aid" will not strive to provide the user with a "flat" response over all frequency bands, but may instead intentionally peak the hearing ability at selected frequencies. Consequently, it will be appreciated by one skilled in the art that schemes and discussions related to equalization of individual sound systems are equally applicable to the "unequalization" required by individual hearing aids. Therefore, although much of the following discussion refers to equalization of sound systems by selective frequency dependant amplification, a person skilled in the art will recognize that the technology for achieving frequency dependent amplification to achieve "unequalization" as is necessary for tuning hearing aids is the same.

More recently, automated equalization schemes have been proposed. For example, one such proposed scheme is an automated graphic equalizer. Such an equalizer has a plurality of channels having fixed center frequencies and fixed Qs (ratio of center frequency to bandwidth of the channel) that cover the entire audio band with filters. It has been proposed to automate the equalization process with such an equalizer by using instruments to record the spectral behavior of a loudspeaker in an environment, and then, in an automated fashion apply to varying degrees such filters so as to compensate the loudspeaker performance and thus bring the resulting spectral behavior of the loudspeaker more closely to a target curve. The approach is limited in its capacity for optimization, and the equalizer is complex, making this approach impractical for widespread use in, e.g., low cost consumer audio products.

Another proposed scheme proposes equalizing a sound field by automatically deriving an inverse filter that is embodied in a combination of fast Fourier transforms (FFTs) and finite impulse response (FIR) filters. The inverse filter implementation is quite complex, however, requiring considerable computational resources, thus making this approach impractical also for widespread use in, e.g., consumer audio products. In addition, there is no provision for re-optimization in this scheme.

Therefore, it would be desirable to have a method and/or apparatus for the automatic equalization (i.e., tuning) of the speaker in a hearing aid that does not involve excessive complexity in implementation, such as for example, implementation costs, power consumption and size. It would also be desirable to have a method and/or apparatus for the automatic equalization or tuning of a hearing aid loudspeaker that automatically re-optimizes the equalization. The present invention provides such methods and apparatus.

SUMMARY OF THE INVENTION

The present invention provides apparatus and methods for generating digital filters for tuning a hearing aid. Therefore, according to one embodiment, first digital data is provided for a tolerance range for a target response curve of sound level versus frequency for the hearing aid. Second, digital data is provided representing an "audiogram" or a response curve of an individual's sound level perception versus frequency. The first digital data is compared with the second digital data and those responses of the audiogram not within the tolerance range are determined. The parameters for determining a digital audio filter are then generated, and the resulting digital audio filter is applied to the hearing aid to generate a compensated audiogram or response curve. According to other embodiments, iterative audiograms and the determination of one or more additional filters as well as fine tuning of the filter continues until the hearing aid is optimized for the individual. For example, the frequency amplitude and bandwidth of the digital audio filters are automatically optimized until the compensated response curve is within the tolerance range, or a predetermined limit on the number of digital audio filters has been reached, whichever occurs first.

These and other features of the invention will be apparent to those skilled in the art from the following detailed description of the invention, taken together with the accompanying drawings.

DETAILED DESCRIPTION OF THE PREFERRED EMBODIMENT

Figure 1:
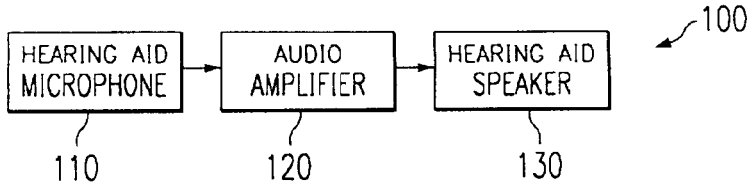
FIG. 1 (PRIOR ART)
FIG. 1 is a high level block diagram of a typical prior art hearing aid.

A typical prior art hearing aid 100 is shown in FIG. 1. The hearing aid 100 is comprised of a microphone 110, audio amplification 120, and a speaker 130. Early hearing aids provided amplification across the audio spectrum. However, there was generally an attempt to pick the center frequency of the amplifier to coincide with the frequency at which the wearer was most likely to be experiencing the most impairment. These early single frequency systems were followed by improved systems which included two, three or even more filters so that specific frequency bands in the hearing aid could be amplified to different levels.

Figure 2:
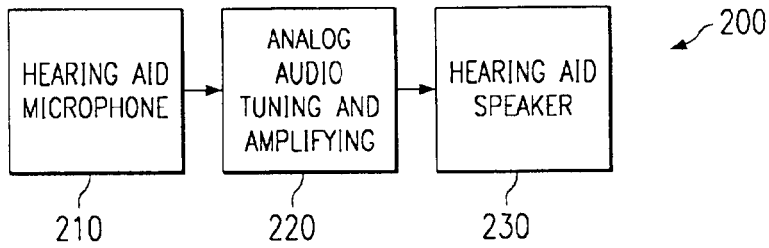
FIG. 2 (PRIOR ART)
FIG. 2 is block diagram of a typical prior art analog hearing aid.

Previously, such systems have been completely analog as is shown in the analog hearing aid 200 of FIG. 2. In FIG. 2, an analog hearing aid receives an audio input from a microphone 210 which provides an electrical signal to the analog audio processing function 220, which allows the amplification of selected frequency bands to be adjusted. The signal output from the analog audio processing function 220 is then provided to the speaker 230 of the hearing aid.

Figure 3:
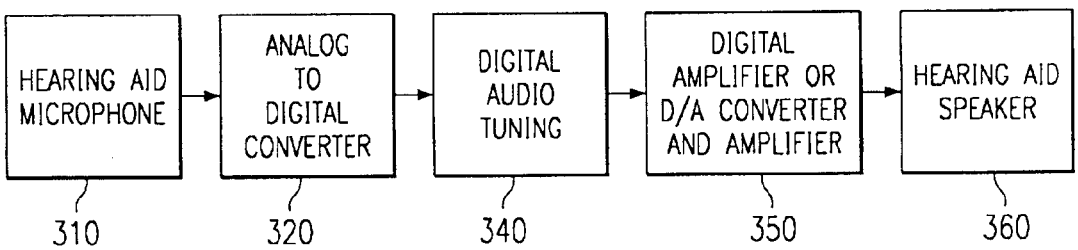
FIG. 3 (PRIOR ART)
FIG. 3 is a typical prior art digital hearing aid.

Currently, hearing aids are becoming increasingly digital. A conceptual digital system 300 is shown in FIG. 3. This digital hearing aid 300 is actually comprised of both analog and digital elements since environmental sound inputs and the speaker system 360 is necessarily analog. However, this is referred to as a digital system since the audio signals are all digital prior to reconstruction and playback. The digital hearing aid 300 is comprised of a microphone 310 for receiving sounds occurring in the environment of the individual wearing the hearing aid. The signal output from microphone 310 is provided to an analog to digital converter 320, and then to a digital audio processing function 340, where it is digitally processed. Such digital processing typically includes tuning or selected, amplification of selected frequency bands. Once the digital processing is completed, the signal is converted back to analog by a digital-to-analog converter ("D/A") 350. The resulting analog signal is then provided to hearing aid speaker 360.

It will also be appreciated by those skilled in the art that although the circuitry of FIG. 3 includes a DAC 350, such a DAC is not necessary. For example, if the amplifier in circuitry 340 is digital, the amplified signal could remain digital up to the speaker 360 when it would then be converted to analog by the speaker itself or by a simple passive filter (not shown) across the speaker terminals.

Of the various hearing aid architectures discussed above, the digital hearing aid of FIG. 3 offers the most flexibility for audio processing. This is due to the ease with which digital signals can be processed. Whereas analog signals typically require larger components and processing is further limited by the lack of analog components to perform many mathematical functions, digital signal processing allows the application of almost any mathematical function to digital signals. In addition, the extremely small size of present day micro circuitry makes digital processing even more attractive for use in hearing aids.

Due to this flexibility, the current trend in almost every type of audio processing is toward digital functionality. An embodiment of the present invention presents a novel method of tuning, including an automatic method for calculating filter tuning coefficients and applying them in the digital domain.

In a more general sense than discussed above, hearing aid tuning is the process of modifying an audio signal prior to playback by the speaker in order to create a speaker response to compensate for a hearing impairment so that the wearer "hears" sounds as close as possible to those sounds heard by an individual not suffering from a hearing impairment. That is, the speaker output is effectively shaped to compensate for hearing loss by the influence of the tuning process on the audio signal. A flat response of the speaker is normally desired for a public sound system since it allows the sound spectrum to pass through the speaker without audible degradation. However, as discussed above, the speaker output of a hearing aid is almost never flat since hearing loss usually varies with frequency. Although hearing aids are normally tuned to compensate for hearing loss by an individual, it will be appreciated that the sound spectrum of a hearing aid could also be shaped in some way to create a particular sound effect, to enhance intelligibility or the detection of a specific sound, to compensate for a specific listening environment, or provide other audio processing functions as desired.

As discussed above, hearing aid tuning can be performed in either the analog or the digital domain. However, current trends in audio processing and the desirability for smaller and smaller size highlights the need for the inexpensive, highly-flexible, readily-adaptable, digital domain tuning capability.

Figure 4:
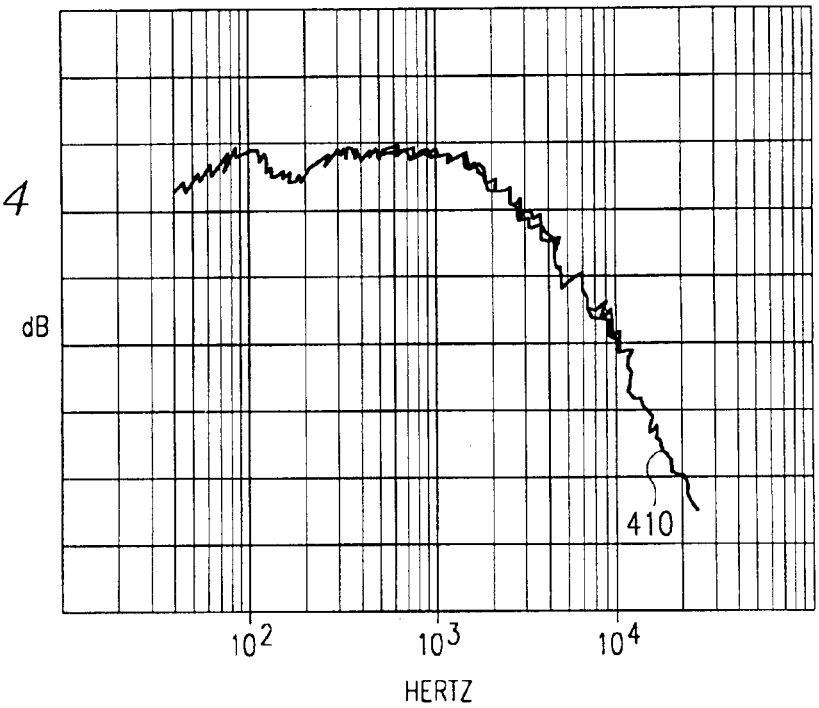
FIG. 4 is a graph showing a typical air threshold response audiogram of an individual.

FIG. 4 is a graph in which the horizontal axis represents frequency in Hertz and the vertical axis represents the sound level heard or perceived by an individual in decibels. Thus, the curve 410 shows a typical audiogram of an individual. An individual with the hearing capacity shown in FIG. 4 has very little response to frequencies above 5000 Hz, and so it is fair to say that the high frequency response is significantly degraded. Therefore, a properly tuned hearing aid will significantly amplify the sound spectrum at the high ends; and this amplification will allow the listener to hear sounds at frequencies that would be missed or completely unheard without the hearing aid. This invention provides a method for correcting such a hearing impairment that may be readily implemented in a relatively low cost hearing aid that includes a multi-purpose digital signal processor, or other circuitry.

Figure 5:
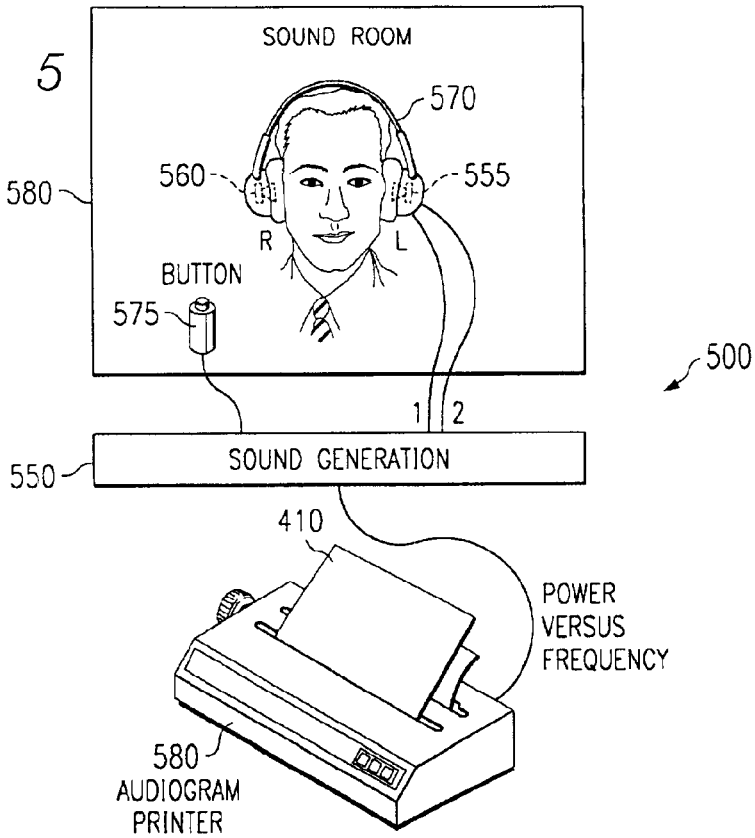
FIG. 5 is a typical arrangement for generating an air threshold response audiogram.

According to a first embodiment, the audiogram 410 shown in FIG. 4 is generated by measuring an individual's ability to hear sounds at different frequencies across the audio spectrum by the air threshold response equipment 550 such as that shown in FIG. 5. In generating such a curve or audiogram, sound equipment 550 generates an audio electrical signal and sends it to a pair of left and right speakers 555 and 560 mounted in a headset 570. The audio signal is a tone at a known frequency which starts at such a low power level that it is inaudible to substantially everyone. However, as mentioned above, bone conduction threshold response may also be used to tune the hearing aid. The power level or volume slowly increases until the individual being tested provides an indication that he or she hears the tone such as by a button switch 575. A different frequency is then selected and the process is repeated until the entire audio spectrum has been covered. As discussed, the audio signal is received via a speaker 555 or 560 located in proximity to or covering an individual's ear, and the resulting indication by the individual that the sound has been heard is sent to the sound processing equipment 550. The information is then processed to compute the response level across the audio spectrum and provided to a recorder or printer 580 to generate a corresponding sound level response curve or audiogram, such as curve 410 in FIG. 4. The system 500 is typically deployed inside a sound room 580 which is insulated from outside sounds, and also absorbs sounds so as to prevent sound reflections. Consequently, the only sound the individual should hear is from the earphones. This eliminates the distraction of echoes and other environmental effects.

Once the initial audiogram of an individual is determined, the appropriate filters can be computed and added to a digital hearing aid to compensate or enhance the individual's hearing ability so as to bring the hearing ability as close as possible to a desired ability.

As was mentioned, typically the compensation or enhancement is to improve or correct the hearing ability of an individual having some type of hearing impairment. However, the enhancement could be used to give an individual with normal and acceptable hearing the capability of substantially enhanced hearing at selected frequency bands or in extremely noisy environments.

It should be appreciated that although determining the coefficients for setting one or more filters in the manner as discussed above will provide significantly improved hearing ability to an individual, the hearing aid system can be further tuned by additional fine tuning of the filters determined from the original or initial audiogram, or including additional filters in the hearing aid. To fine tune the hearing aid system, testing of the hearing ability of the individual or generation of another audiogram is accomplished while the individual is wearing the hearing aid with the initial filter settings. This new audiogram of the hearing ability of the individual should indicate significant improvement over the original audiogram. However, the new audiogram may well indicate that the individual's hearing ability still has room for improvement. Thus, the values of the existing filter can be fine tuned and/or new filters added. Still another audiogram can be generated while the individual is wearing the twice tuned hearing aid and the process repeated until no further meaningful improvement is achieved.

Figure 6:
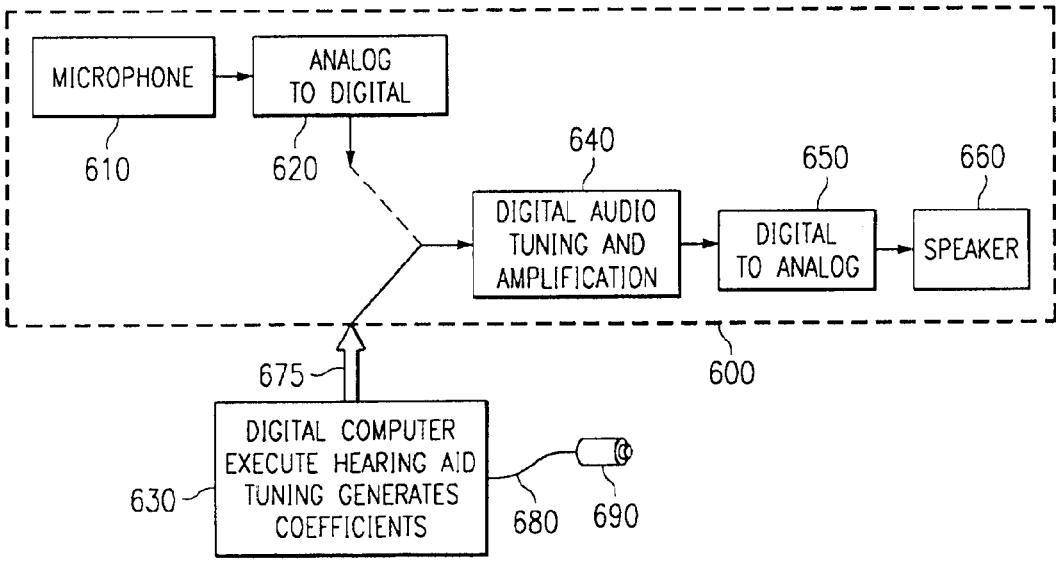
FIG. 6 is a diagram showing an audio system with attached automatic tuning.

According to another embodiment, an air threshold response tuning process may be accomplished by fitting the individual with a completely untuned hearing aid and locating him or her in a sound room such as discussed in FIG. 5. It will also be appreciated by those skilled in the art, that with minor alteration of the equipment shown in FIG. 5, a "Bone Conduction Threshold Response" timing process may be accomplished. The hearing aid is connected to a digital sound source and automatic tuning circuitry which will reiteratively provide digital signals representing known levels of sound at specific frequencies, while at the same time reiteratively computing and setting appropriate coefficients for one or more filters in the hearing aid. FIG. 6 shows a hearing aid 600 with attached automatic tuning circuitry. Hearing aid 600 is like the hearing aid 300 of FIG. 3. Thus, the hearing aid 600 contains an analog microphone 610 and an analog to digital converter A/D 620, which will be disabled for this embodiment. There is also a source of digital signals from computer controlled system 630 which accurately represents analog sounds having a precise frequency and power levels. The known digital signals are provided to the hearing aid 600 in the same manner as if these were from the analog to digital ("A/D") converter 620, and all audio processing is accomplished in the digital domain, in a digital audio processing and tuning unit 640 just as was discussed with respect to FIGS. 3 and 5. After audio processing, the signal is converted back to analog by a D/A converter 650, and provided to the hearing aid speaker 660.

However, also included is a control and data link 675 to digital computer 630 which is, in turn, connected by link 680 to the button or switch 690 in the sound room and used by the individual wearing the hearing aid to indicate he hears the sound at a specific frequency and power level. (See FIG. 5) Computer 630, of course, is not permanently attached to the hearing aid 600. New filter coefficient updates for the digital audio processing in the hearing aid 640 are provided on link 675. Thus, the filter coefficient can be modified to accommodate different hearings aids worn by different individuals or different environments and different listening preferences.

As discussed, this configuration allows applying the computed filter coefficient to a selected hearing aid by an individual in order to fine tune and verify the effectiveness of the correction. This is desirable since every patient is different and their response to the sounds may not be as expected or predicted even if the hearing aid model is the same and they are all manufactured the same. That is, the patient simply may not respond to an initial correction as predicted. Accordingly, computer controlled system 630 sends a digital audio signal through the hearing aid amplifier and tuning circuit 640 which contains filtering and then to the hearing aid speaker 660. The hearing aid 660 also, of course, includes a D/A converter for converting the resultant filtered digital audio signal to an analog signal suitable for the speaker 660. The speaker output is sound that is sensed by the individual wearing the hearing aid. The individual hears a tone of known frequency and amplitude and sends a signal by means of switch button 690 back to the computer controlled circuitry 630.

The first time through this sequence, the hearing aid filter coefficients are all set as all-pass filters, meaning the filters do not affect the sound level characteristic of the hearing aid. Once the initial measurement has been made, an automatic tuning circuitry 600 in computer controlled circuitry 630 determines a set of filter coefficients which are returned to the hearing aid 600 being fitted to the individual to tune the hearing aid output. Methods for determining these coefficients are discussed below.

The coefficients thus determined are transmitted to filters in the hearing aid and are used to change the characteristics of the filters which are applied to the received digital audio signal. The evaluation cycle is performed again with these new coefficients in place. The new measurement shows the improvement made by the filters thus calculated. If the new measurement shows the need for further correction, the computer controlled circuit 630 computes additional coefficients and the cycle is repeated.

The equalization coefficients for the system of FIG. 6 may be generated in a digital computer using a novel automatic algorithm. A flow chart for this algorithm is shown in FIG. 7.

Figure 7:
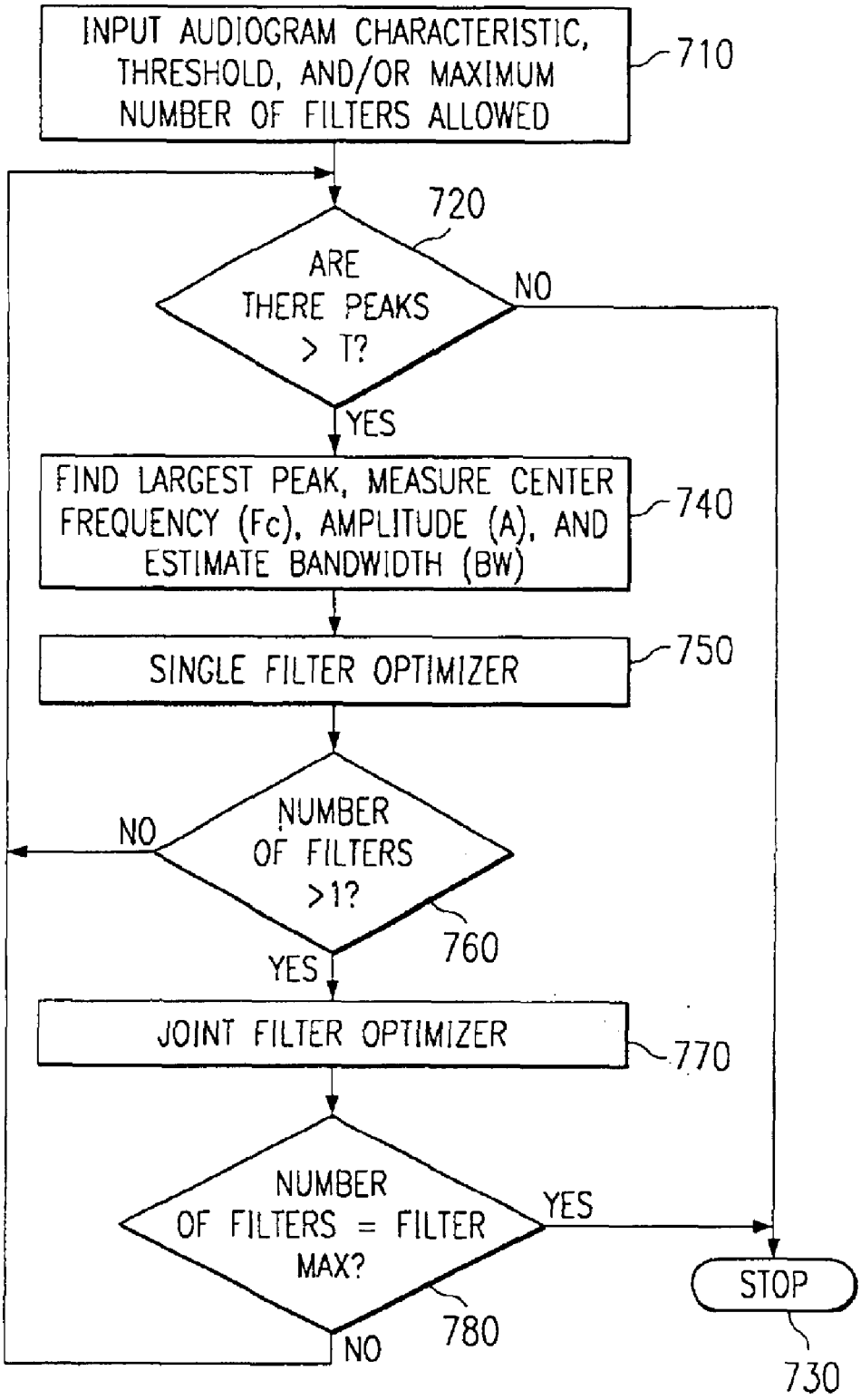
FIG. 7 is a flow chart showing an automatic loudspeaker equalizer algorithm.

Preferably, a second order infinite impulse response ("IIR") equalization filter algorithm is used as the digital filter algorithm for the algorithm shown in FIG. 7. On the other hand, the particular method for determining the coefficients of such second order IIR equalization filters is not of critical importance to the invention. Any digital filter algorithm for generating filters, FIR or higher order IIR filters, determined by the coefficients of the equations specifying the filters, may be used in this method. In addition, the method for estimating A, Fc and BW is not critical, since the single filter optimizer, described below, reiteratively adjusts these values. Furthermore, it should be understood that FIR filter or other techniques may be employed, if so desired.

In the preferred embodiment the value of Fc is initialized to the frequency where maximum deviation from the desired response curve occurs, e.g., as found in step 720, below, and A is initialized to the negative of that maximum deviation. BW is estimated by determining the 3 dB dropoff point from the maximum deviation, and using that value.

For example, suitable methods for determining the filter coefficients are disclosed in Orfanidis, S J, "Digital Parametric Equalizer Design with Prescribed Nyquist-Frequency Gain," 101$^{st}$ Audio Engineering Society Convention, 4361 (I-6), Nov. 8–11, 1996, Los Angeles, Calif., and in Bristow-Johnson, R., "The Equivalence of Various Methods of Computing Biquad Coefficients for Audio Parametric Equalizers," AES, 97$^{th}$ Convention, 3966 (K-6), November 1994, are both applicable. The method of Zolzer and Boltze (99$^{th}$ Convention of AES, Oct. 6–9, 1995) (hereinafter referred to as "the Zolzer and Boltze article") is also applicable, and is perhaps more readily comprehended. It provides a method for generating coefficients for a five coefficient bi-quadratic discrete-time filter. Key aspects of the method presented in the Zolzer and Boltze article are summarized here, for exemplary purposes:

Let:

Fs=sample rate,

Fc=center frequency,

BW=filter bandwidth, and $$V_0 = \text{filter gain factor} = 10^{\frac{A}{20}}.$$

Then:

$$\omega_b T/2 = \pi \cdot BW/Fs, \text{ and}$$

$$\Omega_c = 2\pi \cdot Fc/Fs.$$

Now, if a filter with a positive dB gain, i.e., having a linear gain of greater than one (known as a 'boost' filter), is to be designed, $a_B$ is computed according to Equation (54) of the Zolzer and Boltze article, which can be rewritten by substituting from the above to be:

$$a_B = \frac{\tan(\pi BW/Fs) - 1}{\tan(\pi BW/Fs) + 1}$$

If a filter with a negative dB or fractional linear gain (known as a 'cut' filter) is to be used, the value $a_c$ is computed according to Equation (55) of the Zolzer and Boltze article, which can be rewritten by substituting from above to be:

$$a_C = \frac{\tan(\pi BW/Fs) - V_0}{\tan(\pi BW/Fs) + V_0}$$

Equation (56) of the Zolzer and Boltze article is rewritten as:

$$d = -\cos(2\pi Fc/Fs)$$

$H_0$ is computed according to Equation (58) of the Zolzer and Boltze article:

$$H_0 = V_0 - 1$$

Figure 8:
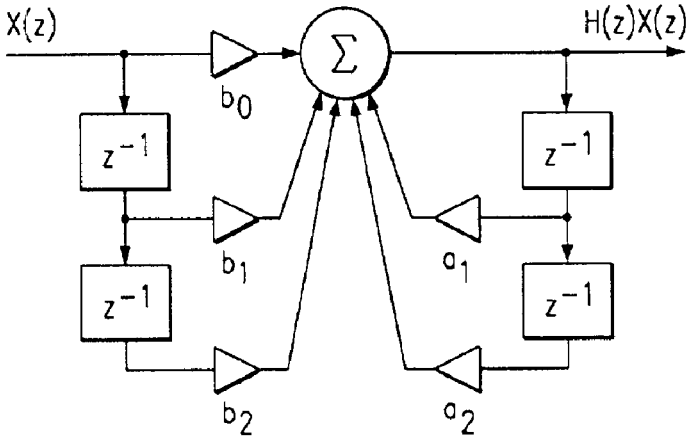
FIG. 8 is a diagram showing a five coefficient bi-quadratic discrete-time filter, in direct form.

Referring to FIG. 8, which shows a five coefficient biquadratic discrete-time filter, in Direct form, the final filter transfer function is as in Equation (59) of the Zolzer and Boltze article:

$$H(z) = \frac{1 + (1 + a_{BC})\frac{H_0}{2} + d(1 - a_{BC})z^{-1} + \left(-a_{BC} - (1 + a_{BC})\frac{H_0}{2}\right)z^{-2}}{1 + d(1 - a_{BC})z^{-1} - a_{BC}z^{-2}}$$

Where $a_{BC}$ is $a_B$ for the boost case, or $a_C$ for the cut case. Those skilled in the art will recognize that this equation is a complex function and thus comprehends both phase and magnitude. Although only the speaker's magnitude response of the hearing aid is being considered, the filters themselves are dealt with as complex functions, and so phase and magnitude interactions are dealt with in the derivation of the compensating filter scheme. Those skilled in the art will also recognize that the filter coefficients then have the following forms:

$$b_0 = 1 + (1 + a_{BC})\frac{H_0}{2}$$

$$b_1 = a_1 = d(1 - a_{BC})$$

$$b_2 = \left(-a_{BC} - (1 + a_{BC})\frac{H_0}{2}\right)$$

$$a_2 = -a_{BC}$$

Included below is a Matlab function for computing the coefficients in the manner indicated:

```
function [B, A]=apcoef(A, BW, Fc, Fs)
if A<1
    a=(tan(pi*BW/Fs)-A)/(tan(pi*BW/Fs)+A);
    else
    a=(tan(pi*BW/Fs)-1)/(tan(pi*BW/Fs)+1);
    end
    H=A-1;
    d=-cos(2*pi*Fc/Fs);
    b0=1+(1+a)*H/2;
    b1=d*(1-a);
    a1=b1;
    b2=(-a-(1+a)*H/2);
    a2=-a;
    B=[b0 b1 b2];
    A=[1 a1 a2];
```

As an example, let A=2, Fc=1000, BW=500, and Fs=44100:

$$B=[b_0\ b_1\ b_2]=[1.03440794155482\ -1.91161634125903\ 0.89677617533555]$$

$$A=[1\ a_1\ a_2]=[1.00000000000000\ -1.91161634125903\ 0.93118411689037]$$

Figure 9:
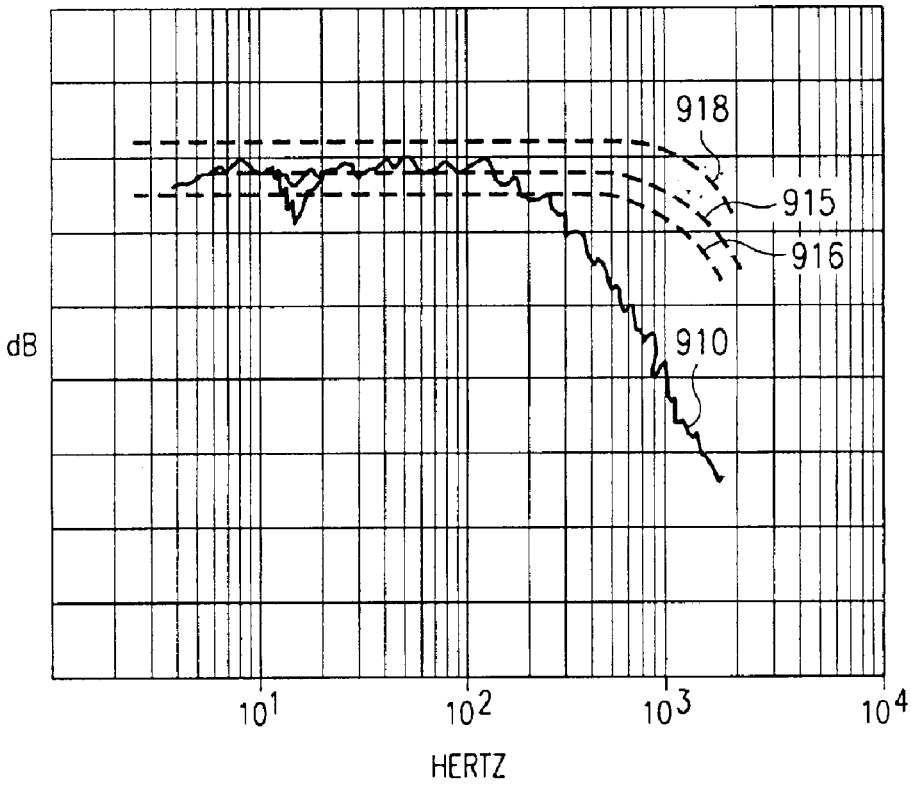
FIG. 9 is a graph showing a typical individual response or audiogram superimposed on a desired response or hearing ability and acceptable tolerance curves.

The automatic hearing aid algorithm of FIG. 7 operates as follows, with the optimizers being detailed below:

Step 710:

Input the audiogram characteristic curve 910, as shown in FIG. 9 (this is the same curve 410 as that shown in FIG. 4), in which the horizontal axis represents frequency in Hertz and the vertical axis represents sound level in decibels. This curve is input as digital data from the digital signal generator in computer controlled system 630. Also input the desired response curve 915 or audiogram, as shown in FIG. 9. Generally, the individual will desire a flat response over as much of the frequency range as possible, but the desired response curve or desired audiogram 915 should be chosen keeping in mind the physical limits of the hearing aid and the physical limits of the patient under consideration. The desired audiogram 915 shown in FIG. 9, for example, represents a goal of flattening the response from about 2000 Hz up. Finally, the lower tolerance and the upper tolerance are input, as shown in FIG. 9 by the dotted line curves 916 and 918, respectively. The algorithm is capable of flattening the response to a relatively high degree. But, typically, deviations in sound level of less than two to three dB are not objectionable, and so only a small amount of correction, and thus a small amount of system resources are required. The tolerance range represented by the dotted line curves 916 and 918 is determined accordingly, so as to provide an acceptable amount of compensation to the speaker using an acceptable amount of system resources to accomplish the compensation.

Step 720:

Test to see if there are any regions in the (current) filter response curve that are beyond the tolerance levels, i.e., peaks.

Step 730:

If the result of step 720 is negative, stop. Obviously, a hearing aid is not required, or the hearing aid provides the best fit to the desired algorithm without any filters being activated. However, it should be appreciated that since the process is iterative, the test could go negative during a later iteration to indicate sufficient filters are being used.

Step 740:

If the result of step 720 is positive, use any of the aforementioned methods to find the largest peak, estimate the amplitude ("A"), center frequency ("Fc"), and the bandwidth ("BW"), of the filter needed for correction.

Step 750:

Provide the information from step 740 to a single filter optimizer subroutine operation, described below in conjunction with FIG. 10, which finds the single filter that best corrects this region of the curve.

Step 760:

Check to see if the number of filters is greater than one. If not, return to 720.

Figure 12:
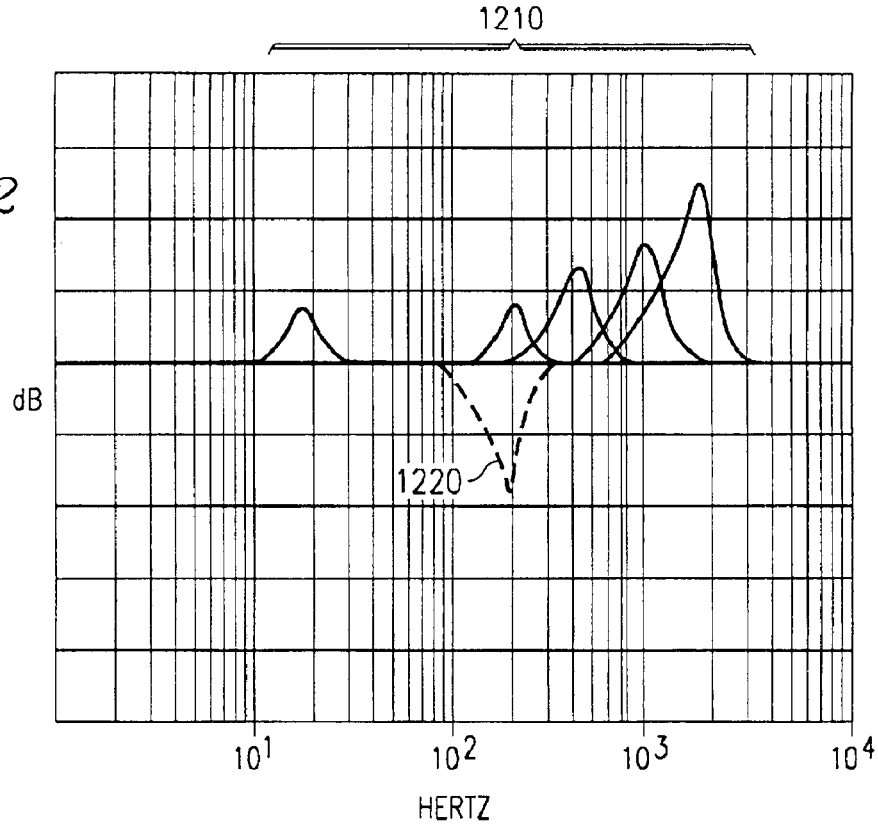
FIG. 12 is a graph showing equalization filter behavior.

Step 770:

If the number of filters is greater than one, provide the information from step 740 to the joint filter optimizer subroutine, described below in conjunction with FIG. 12, to jointly optimize all current filters.

Step 780:

Has the maximum number of filters, FilterMax, been reached or is current speaker response completely within tolerance? If not, return to 720. If either of the two conditions is met, go to step 730, i.e., stop.

Figure 10:
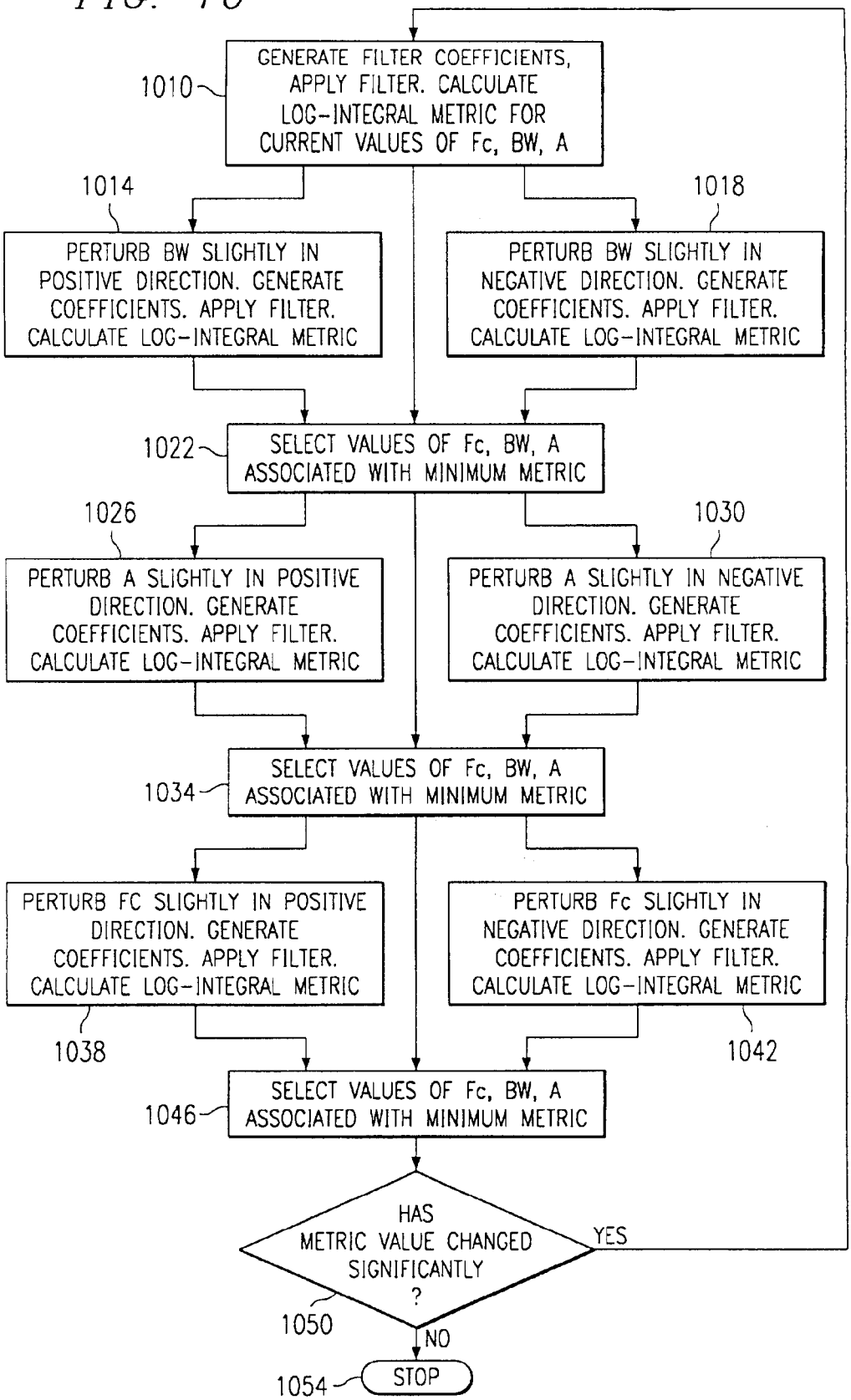
FIG. 10 is a flow chart showing a single filter optimizer.

The single filter optimizer operation referred to in step 750 of FIG. 7 is shown in a flow chart in FIG. 10. It operates in the following manner:

Step 1010:

Generate a second-order filter using a suitable method, such as one of the Orfanidis, Zolzer Boltze or Bristow-Johnson methods, mentioned above, or any other suitable method, from the initial values of Fc, BW, and A. Apply this filter to the filter characteristic and calculate the total log-integral metric of the deviation of the recorded speaker characteristic curve 410 (or 910) from the desired response curve 915. The total log-integral metric takes into account the fact that the human ear hears on an octave scale as opposed to a linear scale, and relates to the area between the recorded speaker characteristic curve 910, as modified by application of the designed filters, and the desired response curve 915, where the vertical axis is in decibels and the horizontal axis is in the logarithm of the frequency. It is determined by the following formula:

$$M = \sum_{i=1}^{N-1} \log_{10}\left(\frac{f_{i+1}}{f_i}\right)\left[\frac{|S(f_i)_{dB} - D(f_i)_{dB}| + |S(F_{i+1})_{dB} - D(f_{i+1})_{dB}|}{2}\right]$$

where:

M is the total log-integral metric, f is the frequency,

D is the desired response characteristic,

S is the magnitude of the composite transfer function, comprised of the speaker characteristic, as modified by the designed filters, and N is the number of points in the characteristic.

Steps 1014 and 1018:

Perturb the BW slightly in both the positive (step 1014) and in the negative (step 1018) directions. Generate new coefficients for each filter. Apply each filter in turn, and recalculate the total log-integral metric for each case. Alternatively, the results of a new measurement could be used instead of the calculated result of the application of a filter.

Step 1022:

Select, from the original and the two perturbations the BW that produces the lowest total log-integral metric.

Steps 1026 and 1030:

Perturb A slightly in the positive (step 1026) and negative (step 1030) directions. Generate new coefficients for each filter. Apply each filter in turn, and recalculate the total log-integral metric for each case.

Step 1034:

Choose the value of A that produces the lowest total log-integral metric.

Steps 1038 and 1042:

Perturb Fc slightly in the positive (step 1038) and negative (step 1042) directions. Generate new coefficients for each filter. Apply each filter in turn, and recalculate the total log-integral metric for each case.

Step 1046:

Choose the value of Fc that produces the minimum total log-integral metric value.

Step 1050:

Is the change in the metric greater than the change threshold? If it is, return to 1010 for further optimization.

Step 1054:

If the change in the metric is not greater than the change threshold, stop. Single filter optimization is complete.

Figure 11:
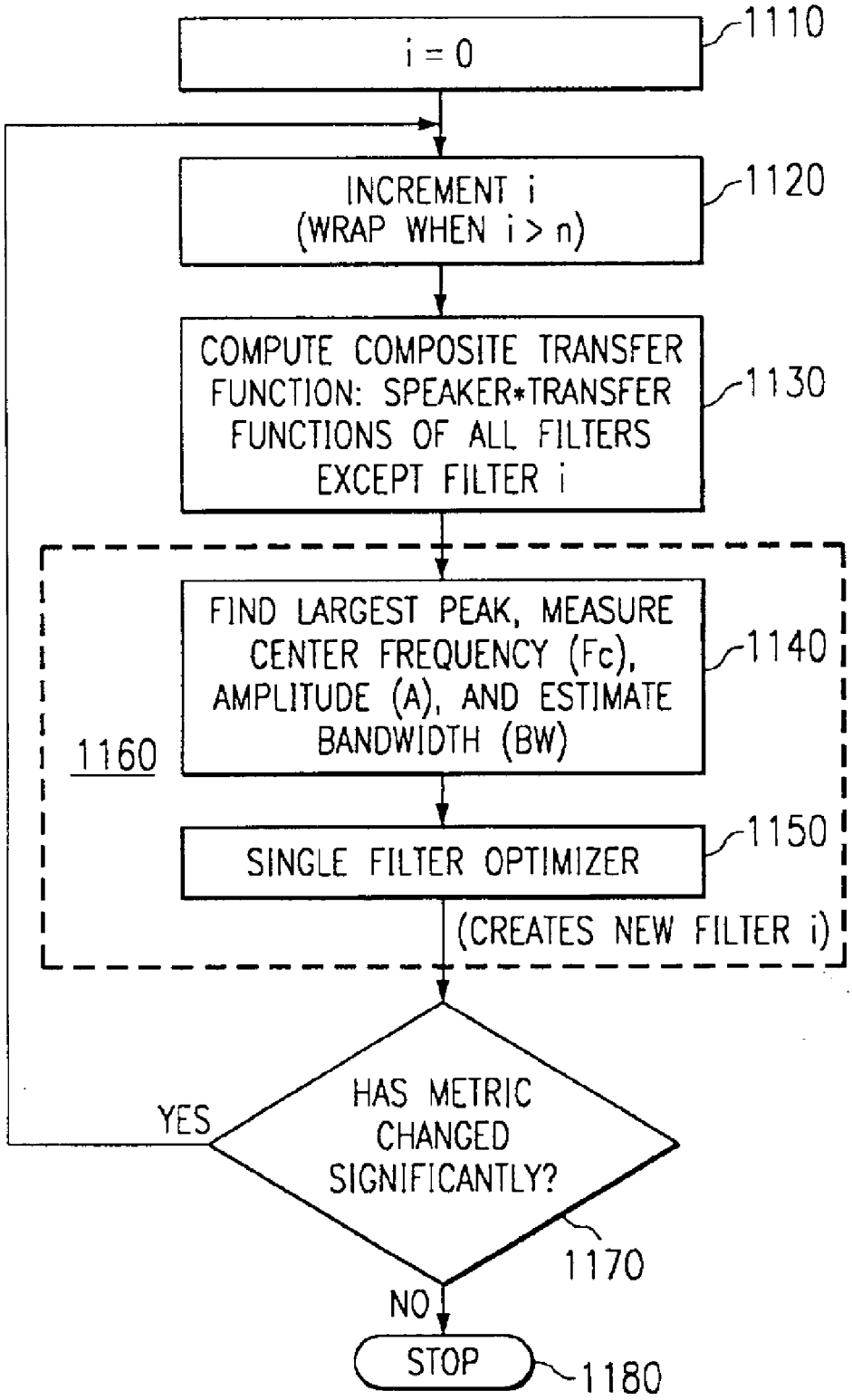
FIG. 11 is a flow chart showing a joint filter optimizer.

The joint filter optimizer operation referred to in step 770 of FIG. 7 is shown in a flow chart in FIG. 11. It operates in the following manner:

Step 1110:

Set i=0 to begin.

Step 1120:

Increment i. If i becomes greater than the number of filters, n, make i=1.

Step 1130:

Compute the composite transfer function including the uncompensated speaker response and responses for all but the $i^{th}$ filter. Alternatively, the results of a new measurement could be used instead of the computed composite transfer function.

Step 1160:

Create a new $i^{th}$ filter as follows:

Step 1140:

Find the largest peak in the composite response, estimate the amplitude, A, center frequency, Fc, and the bandwidth, BW, of the filter needed for correction.

Step 1150:

Generate coefficients and optimize the new filter using the single filter optimizer described above in conjunction with FIG. 10.

Step 1170:

Check to see if the total filter metric has changed significantly with the application of the newly designed filter. If so, return to 1120 for further optimization.

Step 1180:

If not, stop. Optimization is complete.

FIG. 12 is a graph, in which the horizontal axis represents frequency in Hertz and the vertical axis represents sound level in decibels, showing plots 1210 of equalization filters generated for the speaker response 910 (or 410) shown in FIG. 9 by applying the method described above in conjunction with FIGS. 8–12. Thus, these plots 1210 would be generated by the automatic hearing aid tuning algorithm of FIG. 8, using the audiogram response 910 shown in FIG. 9, for a desired response 915 shown in FIG. 9. Applying these filters produces the corrected response 1310 shown as a solid line in FIG. 13. Also, for illustration purposes only, it should be appreciated that the filters could include negative correction as shown at reference number 1220 in FIG. 12.

Figure 13:
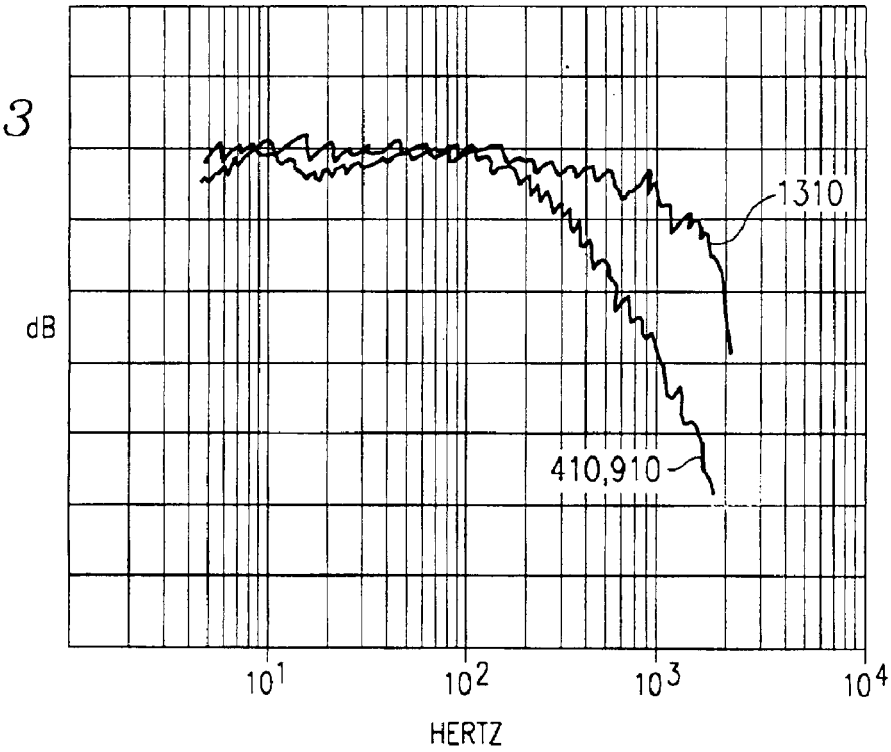
FIG. 13 is an audiogram prior to the use of a tuned hearing aid superimposed on an audiogram of the same individual when using a hearing aid corrected or tuned according to the teachings of this invention.

FIG. 13 also shows the initial audiogram 910 or 410 from FIG. 9, for reference. Those skilled in the art will appreciate that the corrected response or audiogram 1310 represents a considerably improved response over the initial audiogram of the unassisted hearing ability of the individual.

Although the present invention and its advantages have been described in detail, it should be understood that various changes, substitutions and alterations can be made herein without departing from the spirit and scope of the invention as defined by the appended claims. For example, while the joint filter optimization subroutine 720 discussed above in conjunction with FIGS. 7 and 11 is preferred, nonetheless, the principles of the present invention may be applied without a joint filter optimization procedure. Only a single filter optimization would be performed in such case. While the ultimate resulting compensation of the hearing aid would likely be less than that achievable by utilizing both a single filter optimization and a joint filter optimization, for example as shown in FIGS. 7, 10 and 11, nonetheless the reduction in resource requirements by omitting a joint filter optimization might be an overriding consideration to a designer. In addition, after deriving an initial set of compensating filters based solely upon the initial measured response data, then a new measurement could be made with these initial filters applied, and further optimization of those filters could then be performed and/or additional filters be designed. Other variations will occur to those skilled in the art once the principles of the present invention as set forth herein are understood. All such variations are to be considered within the scope of the invention, which is to be limited only by the claims set forth herein.

What is claimed is:

1. A method for generating digital filter coefficients for tuning a hearing aid employing digital audio processing to enhance hearing ability of an individual comprising:

fitting said hearing aid to said individual;

connecting said hearing aid to a source of audio digital signals; providing said individual with a device to generate indication signals at will;

generating and providing a first series of audio digital signals to said hearing aid, each digital signal in said first series of signals corresponding to an analog audio signal having a selected frequency and multiple power levels; at said hearing aid converting each of said series of digital signals into said corresponding analog audio signal;

receiving said indication signal during said generation of a signal of a selected frequency indicative of said individual hearing said selected frequency providing a digital audio processing unit in said hearing aid for processing received audio digital signals corresponding to analog audio signals and providing processed audio digital data, including applying digital audio filters for tuning said hearing aid characterized by generating digital filter coefficients in algorithms applied to said received audio digital signals to effect said digital audio filters;

providing a digital computer connected to receive said first series of audio digital signals and said indication signals to generate digital data representative of said individual's hearing ability using said hearing aid without filters determined from said first series of digital signals, said computer programmed to determine said digital filter coefficients for digital filters for tuning said hearing aid and providing said coefficients to said digital audio processing unit in said hearing aid; and said digital computer is programmed to determine said digital filter coefficients by providing second digital data for a tolerance range for a target response curve ability of representative of said individual's enhanced hearing ability of sound level versus frequency;

providing first digital data representative of an initial response curve of said individual's hearing ability of sound level versus frequency;

comparing said second digital data to said first digital data and determining whether said response curve is within said tolerance range; and if said response curve is not within said tolerance range, iteratively generating digital filter coefficients controlling center frequency, filter bandwidth and amplitude for a succession of additional digital audio filters, applying digital audio filters determined by said digital filter coefficients to said first digital data to generate third digital data for a compensated response curve, and automatically optimizing said digital filter coefficients by optimizing the center frequency, amplitude and filter bandwidth of said digital audio filters until said compensated response curve is within said tolerance range or a predetermined limit on the number of digital audio filters has been reached, whichever occurs first.

2. An apparatus for generating digital filter coefficients for tuning a hearing aid digital audio processing for use by an individual comprising:

a source of first audio digital data corresponding to analog audio signals having a selected frequency and multiple power levels;

a digital audio processing unit in said hearing aid for processing said first audio digital data according to at least one digital filter having digital filter coefficients controlling filter center frequency, amplitude and filter bandwidth and providing processed audio digital data, including applying digital audio filters for tuning said hearing aid characterized by coefficients in algorithms applied to said first audio digital data to effect said digital audio filters a digital to analog converter receiving said processed digital data from said digital audio processing unit and converting said processed digital data into a corresponding analog audio signal;

a speaker receiving said analog audio signal from said digital to analog converter and producing corresponding sound to the individual;

a device for generating indication signals indicative of said individual receiving aid sound; and a digital computer connected to receive said first audio digital data and said indication signals, said digital computer programmed to determine said digital filter coefficients for digital filters for tuning said hearing aid and provide said coefficients to said digital audio processing unit; and said digital computer is programmed to generate second digital data representative of said individual hearing ability when using said hearing aid without filters determined from said first audio digital data and said indication signals and to determine said coefficients by providing third digital data for a tolerance range for a target response curve of enhanced hearing of sound level versus frequency;

providing said second digital data, wherein said second digital data represents an initial response curve of hearing ability of sound level versus frequency;

comparing said third digital data to said second digital data and determining whether said initial response curve is within said tolerance range; and if said initial response curve is not within said tolerance range iteratively generating digital filter coefficients controlling center frequency, filter bandwidth and amplitude for a succession of additional digital audio filters, applying digital audio filters determined by said digital filter coefficients to said second digital data to generate fourth digital data for a compensated response curve, and automatically optimizing said digital filter coefficients by optimizing the center frequency, amplitude and filter bandwidth of said digital audio filters until said compensated response curve is within said tolerance range or a predetermined limit on the number of digital audio filters has been reached, whichever occurs first.

* * * * *